US011094432B2

(12) United States Patent
Oomori et al.

(10) Patent No.: US 11,094,432 B2
(45) Date of Patent: Aug. 17, 2021

(54) COMMUNICATION CABLE AND CRIMPING MEMBER

(71) Applicant: SUMITOMO WIRING SYSTEMS, LTD., Mie (JP)

(72) Inventors: Hiroyuki Oomori, Mie (JP); Yasuaki Nakayama, Mie (JP); Yuki Kondo, Mie (JP); Yasuo Imai, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/016,726

(22) Filed: Sep. 10, 2020

(65) Prior Publication Data

US 2021/0090763 A1 Mar. 25, 2021

(30) Foreign Application Priority Data

Sep. 24, 2019 (JP) ..... JP2019-172565

(51) Int. Cl.
*H01R 4/00* (2006.01)
*H01B 11/08* (2006.01)
*H01R 9/05* (2006.01)

(52) U.S. Cl.
CPC ..... *H01B 11/08* (2013.01); *H01R 9/0518* (2013.01)

(58) Field of Classification Search
CPC . H01R 4/18; H01R 4/185; H01R 4/20; H01R 4/24; H01R 4/26; H01R 11/02; H01R 11/20; H01R 13/42; H01R 13/633; H01R 13/5808
USPC ..... 174/74 R, 78 C, 84 R, 84 C, 94 R; 439/152, 877, 865–868, 851
See application file for complete search history.

(56) References Cited

U.S. PATENT DOCUMENTS 6,402,543 B1 * 6/2002 Abe ..... H01R 4/185 439/407
6,468,116 B2 * 10/2002 Koide ..... H01R 4/184 439/867
10,476,178 B2 11/2019 Hamada et al.
2015/0079825 A1 * 3/2015 Miyamoto ..... H01R 4/62 439/152
2018/0138601 A1 * 5/2018 Hamada ..... H01R 13/5808

FOREIGN PATENT DOCUMENTS

JP 2012-119186 A * 6/2012 ..... H01R 4/18

* cited by examiner

*Primary Examiner* — William H Mayo, III
(74) *Attorney, Agent, or Firm* — Abelman, Frayne & Schwab

(57) ABSTRACT

A twisted pair cable includes a twisted portion in which two communication wires are twisted each other and an untwisted portion in which the two communication wires are untwisted. The terminal is connected to a tip part of the untwisted portion. A crimping member includes a barrel portion crimped to an end part of the twisted portion on the side of the untwisted portion and a non-crimping portion extending from the barrel portion toward the untwisted portion and not crimped to the twisted pair cable. The non-crimping portion includes a facing portion facing the two communication wires in the untwisted portion and rising portions rising from both end part in a direction orthogonal to a longitudinal direction of the untwisted portions in the facing portion. The rising portions surround the two communication wires together with the facing portion.

12 Claims, 13 Drawing Sheets

COMMUNICATION CABLE AND CRIMPING MEMBER

CROSS-REFERENCE TO RELATED APPLICATIONS

This application is based on and claims priority from Japanese Patent Application No. 2019-172565, filed on Sep. 24, 2019, with the Japan Patent Office, the disclosure of which is incorporated herein in their entireties by reference.

TECHNICAL FIELD

The present disclosure relates to a communication cable and a crimping member.

BACKGROUND

Japanese Patent Laid-open Publication No. 2018-078066 describes a technique on a wire mounting member to be mounted on a wire such as a twisted pair cable.

SUMMARY

A twisted pair cable including two communication wires twisted each other may include an untwisted portion in which the two communication wires are untwisted. In a communication cable including such a twisted pair cable, an impedance may increase in the untwisted portion. As a result, it may be difficult to keep the impedance of the communication cable within a desired range.

Accordingly, it is aimed to provide a technique capable of more easily keeping an impedance of a communication cable within a desired range.

The present disclosure is directed to a communication cable with a twisted pair cable including two communication wires twisted each other, a terminal, and a crimping member made of metal, wherein the twisted pair cable includes a twisted portion in which the two communication wires are twisted each other and an untwisted portion in which the two communication wires are untwisted, the untwisted portion extending from the twisted portion, the terminal is connected to a tip part of the untwisted portion, the crimping member includes a barrel portion crimped to an end part of the twisted portion on the side of the untwisted portion and a non-crimping portion extending from the barrel portion toward the untwisted portion and not crimped to the twisted pair cable, and the non-crimping portion includes a facing portion facing the two communication wires in the untwisted portion and rising portions rising from both end parts in a direction orthogonal to a longitudinal direction of the untwisted portion in the facing portion, the rising portions surrounding the two communication wires together with the facing portion.

According to the present disclosure, an impedance of the communication cable is more easily kept within a desired range.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
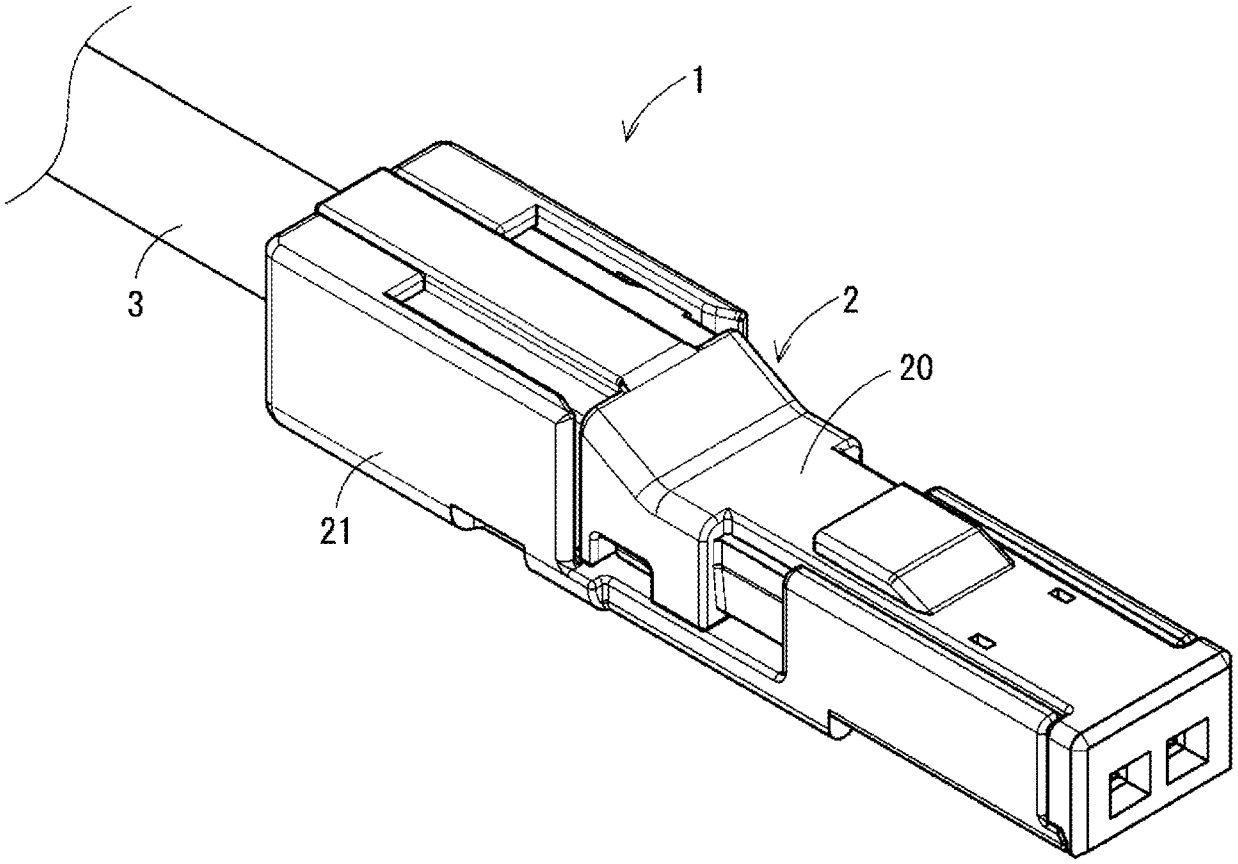
FIG. 1 is a perspective view showing an example of a communication cable according to an embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

A communication cable and a crimping member of the present disclosure are as follows.

(1) The communication cable of the present disclosure is proved with a twisted pair cable including two communication wires twisted each other, a terminal, and a crimping member made of metal, wherein the twisted pair cable includes a twisted portion in which the two communication wires are twisted each other and an untwisted portion in which the two communication wires are untwisted, the untwisted portion extending from the twisted portion, the terminal is connected to a tip part of the untwisted portion, the crimping member includes a barrel portion crimped to an end part of the twisted portion on the side of the untwisted portion and a non-crimping portion extending from the barrel portion toward the untwisted portion and not crimped to the twisted pair cable, and the non-crimping portion includes a facing portion facing the two communication wires in the untwisted portion and rising portions rising from both end parts in a direction orthogonal to a longitudinal direction of the untwisted portion in the facing portion, the rising portions surrounding the two communication wires together with the facing portion. According to the present disclosure, since the rising portions surround the two communication wires of the untwisted portion together with the facing portion in the non-crimping portion, an impedance of the untwisted portion can be reduced. Therefore, an impedance of the communication cable is easily kept within a desired range.

(2) An angle formed by the rising portion and the facing portion may be 90° or less. In this case, since the angle formed by the rising portion and the facing portion is 90° or less, the size of the non-crimping portion for reducing the impedance of the untwisted portion can be made smaller.

(3) A length from one end of the untwisted portion on the side of the twisted portion to the terminal may be 4 mm or less. In this case, since the length from the one end of the untwisted portion on the side of the twisted portion to the terminal is 4 mm or less, an increase of the impedance of the untwisted portion can be suppressed. Therefore, the impedance of the communication cable is easily kept within the desired range.

(4) A length of the barrel portion may be more than 4.0 mm. In this case, since the length of the barrel portion is more than 4.0 mm, the impedance of the untwisted portion can be further reduced. Therefore, the impedance of the communication cable is more easily kept within the desired range.

(5) A distance between cross-sectional centers of the two communication wires in the untwisted portion may be 2.0 mm or less. In this case, since the distance between the cross-sectional centers of the two communication wires in the untwisted portion is 2.0 mm or less, an increase of the impedance of the untwisted portion can be suppressed. Therefore, the impedance of the communication cable is more easily kept within the desired range.

(6) A housing may be further provided which accommodates the terminal and the crimping member.

(7) Fitting recesses into which the rising portions are fit may be provided inwardly of side wall portions of the housing. In this case, since the fitting recesses into which the rising portions are fit are provided inwardly of the side wall portions of the housing, the position of the crimping member can be restricted using the fitting recesses. Therefore, the escape of the terminal from the housing can be suppressed.

(8) The housing may include a body portion for accommodating the terminal and the crimping member and a cover portion for covering the body portion, the fitting recesses may be provided inwardly of side wall portions of the body portion, and the side wall portions of the body portion may include cutout portions in surfaces provided with the fitting recesses. In this case, the side wall portions of the body portion include the cutout portions in the surfaces provided with the fitting recesses. In this way, for a crimping member including hemming bent portions instead of the rising portions, the position of the crimping member including the hemming bent portions can be restricted by arranging the hemming bent portions in the cutout portions. Therefore, the housing can be commonly used for the communication cable with the crimping member including the rising portions and for the communication cable with the crimping member including the hemming bent portions.

(9) The communication cable may meet Ethernet (registered trademark) standards. Since the impedance of the untwisted portion can be reduced in the communication cable of the present disclosure, the communication cable can easily meet the Ethernet standards.

(10) The twisted pair cable may include no cable shield member. In this case, the impedance of the untwisted portion can be reduced even in the case of using an inexpensive twisted pair cable including no cable shield member.

(11) The twisted pair cable may include no cable shield member and the communication cable may include no shield member for covering the housing. In this case, the impedance of the untwisted portion can be reduced even in the case of using an inexpensive twisted pair cable including no cable shield member and no shield member for covering the housing.

(12) A crimping member of the present disclosure may be the crimping member made of metal and provided in the above communication cable.

Details of Embodiment of Present Disclosure

Specific examples of the communication cable and the crimping member of the present disclosure are described below with reference to the drawings. Note that the present invention is not limited to these illustrations and is intended to be represented by claims and include all changes in the scope of claims and in the meaning and scope of equivalents.

Hereinafter, a communication cable 1 according to an embodiment is described. FIG. 1 is a schematic perspective view showing one example of the communication cable 1. The communication cable 1 is used in communication between a certain device and another device, and electrically connects the certain device and the other device. The communication cable 1 is, for example, a communication cable used in communication having a transmission rate of 100 Mbps (bits per second) or higher. The communication cable 1, for example, conforms to Ethernet (registered trademark) standards. The communication cable 1, for example, conforms to 100BASE-T2. The communication cable 1 is, for example, mounted in an automotive vehicle.

Note that the communication cable 1 may be a communication cable used in communication having a transmission rate of higher than 100 Mbps. For example, the communication cable 1 may be a communication cable used in communication having a transmission rate of 1 Gbps. Further, the communication cable 1 may be a communication cable used in communication having a transmission rate of lower than 100 Mbps. Further, the communication cable 1 may not conform to the Ethernet standards. Further, the communication cable 1 may be used in a place other than automotive vehicles.

As shown in FIG. 1, the communication cable 1 includes a housing 2 and a member-equipped twisted pair cable 3. The housing 2 includes a body portion 20 for accommodating one end part of the member-equipped twisted pair cable 3, and a cover portion 21 for covering an opening of the body portion 2. The cover portion 21 is mounted on the body portion 20. The housing 2 has, for example, an elongated shape extending along a longitudinal direction of the member-equipped twisted pair cable 3.

Figure 2:
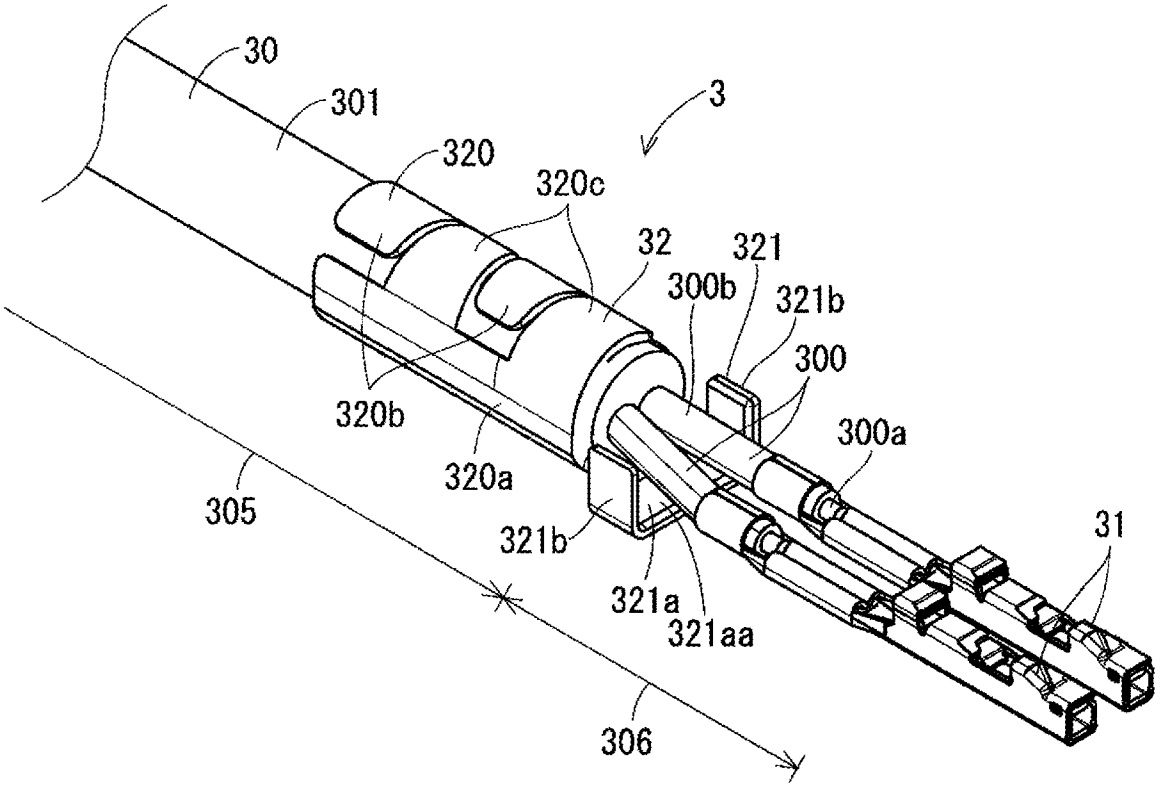
FIG. 2 is a perspective view showing an example of a member-equipped twisted pair cable according to the embodiment.

FIG. 2 is a schematic perspective view showing an example of the member-equipped twisted pair cable 3. As shown in FIG. 2, the member-equipped twisted pair cable 3 includes a twisted pair cable 30, two terminals 31 and a crimping member 32 made of metal. Each terminal 31 is, for example, a terminal made of metal.

The twisted pair cable 30 is, for example, an UTP (Unshielded Twisted Pair) cable. The twisted pair cable 30 includes two communication wires 30 twisted each other. Further, the twisted pair cable 30 includes an insulation coating 301 collectively covering the two communication wires 300. In this example, the twisted pair cable 30 does not include a cable shield member such as a braided wire or aluminum tape. That is, the two communication wires 300 are not covered with any cable shield member. Further, the twisted pair cable 30 includes no drain wire. The communication wire 300 includes a core 300*a* made of metal and an insulation coating 300*b* covering the core 300*a*. The communication wire 300 can also be said to be an electrical wire. An upper limit value of a diameter of the communication wire 300 may be, for example, 1.0 mm or less. Further, the upper limit value of the diameter of the communication wire 300 may be, for example, 0.8 mm or less. Further, the upper limit value of the diameter of the communication wire 300 may be, for example, 0.6 mm or less. Further, a lower limit value of the diameter of the communication wire 300 may be, for example, 0.1 mm or more. Further, the lower limit value of the diameter of the communication wire 300 may be, for example, 0.2 mm or more. Note that the diameter here means a nominal diameter.

The twisted pair cable 30 includes a twisted portion 305 formed by twisting the two communication wires 300 and an untwisted portion 306 extending from the twisted portion 305 and formed by untwisting the two communication wires 300. The untwisted portion 306 is located on an end part of the twisted pair cable 30. In the twisted portion 305, the two communication wires 300 are covered with the insulation coating 301. On the other hand, the two communication wires 300 are not covered with the insulation coating 301 in the untwisted portion 306.

The two terminals 31 are connected to a tip part of the untwisted portion 306. Specifically, the two terminals 31 are respectively connected to tip parts of the two communication wires 300 of the untwisted portion 306. The insulation coatings 300*b* are stripped at the tip parts of the communication wires 300 of the untwisted portion 306 to expose the cores 300*a*. The terminals 31 are crimped to exposed parts of the cores 300*a* and the insulation coatings 300*b* near the exposed parts.

Note that the twisted pair cable 30 may be an STP (Shielded Twisted Pair) cable. In this case, the twisted pair cable 30 may include a drain wire and a cable shield member electrically connected to the drain wire.

The crimping member 32 includes a barrel portion 320 to be crimped to an end part of the twisted portion 305 on the side of the untwisted portion 306. The crimping member 32 also includes a non-crimping portion 321 extending from the barrel portion 320 toward the untwisted portion 306 and not to be crimped to the twisted pair cable 30.

The non-crimping portion 321 includes a facing portion 321*a* facing the two communication wires 300 in the untwisted portion 306. The non-crimping portion 321 also includes a pair of rising portions 321*b* rising from both end parts in a direction orthogonal to a longitudinal direction of the untwisted portion 306 in the facing portion 321*a* and surrounding the two communication wires 300 together with the facing portion 321*a*.

Figure 3:
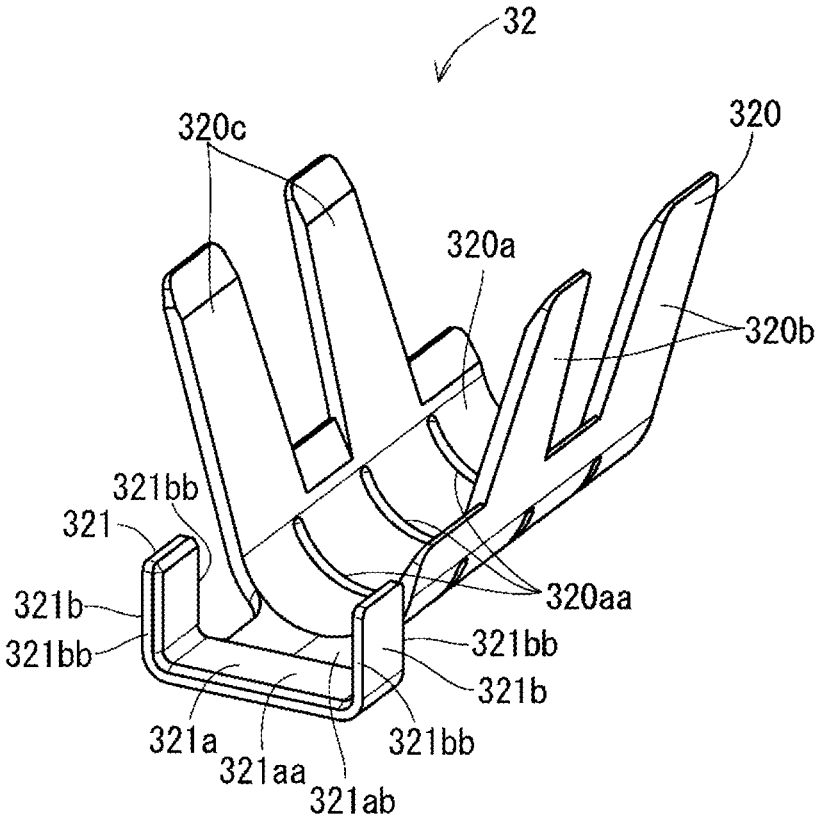
FIG. 3 is a perspective view showing an example of a crimping member according to the embodiment.
Figure 4:
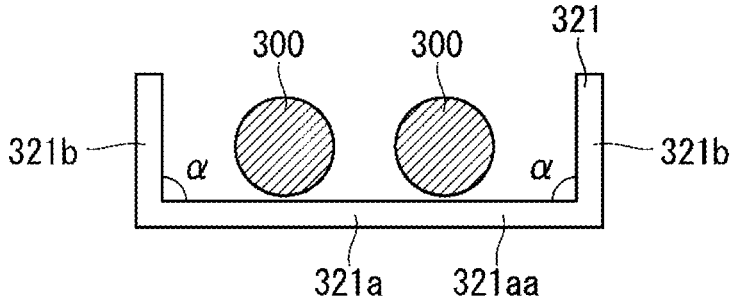
FIG. 4 is a section showing an example of a non-crimping portion according to the embodiment.

FIG. 3 is a schematic perspective view showing an example of the crimping member 32. The crimping member 32 including the barrel portion 320 before being crimped to the twisted portion 305 is shown in FIG. 3. FIG. 4 is a section schematically showing the non-crimping portion 321 of the crimping member 32 crimped to the untwisted portion 306 when viewed from a longitudinal direction of the untwisted portion 306. Cross-sections of the two communication wires 300 of the untwisted portion 306 are shown in FIG. 4.

As shown in FIGS. 2 and 3, the barrel portion 320 includes a placing portion 320*a* on which the twisted portion 305 is placed. The placing portion 320*a* extends along a longitudinal direction of the twisted portion 305 and is curved into a U shape. The placing portion 320*a* is provided with a plurality of slits 320*aa*. The plurality of slits 320*aa* are arranged while being separated from each other along a longitudinal direction of the placing portion 320*a*. Each slit 320*aa* extends along the curving of the placing portion 320*a*.

As shown in FIG. 3, the barrel portion 320 includes a plurality of crimping pieces 320*b* extending obliquely upward toward an outer side from one side edge along the longitudinal direction of the placing portion 320*a*. In this example, the barrel portion 320 includes two crimping pieces 320*b*. The two crimping pieces 320*b* are arranged while being separated from each other along the longitudinal direction of the placing portion 320*a*.

Further, the barrel portion 320 includes a plurality of crimping pieces 320*c* extending obliquely upward toward an outer side from the other side edge along the longitudinal direction of the placing portion 320*a*. The number of the plurality of crimping pieces 320*c* is equal to that of the plurality of crimping pieces 320*b*. In this example, the barrel portion 320 includes two crimping pieces 320*c*. The two crimping pieces 320*c* are arranged while being separated from each other along the longitudinal direction of the placing portion 320*a*.

The barrel portion 320 is so crimped to the twisted portion 305 that the placing portion 320*a*, the respective crimping pieces 320*b* and the respective crimping pieces 320*c* are in contact with the outer peripheral surface of the twisted portion 305. The crimping pieces 320*b* and the crimping pieces 320*c* are alternately so arranged as not to overlap each other with the barrel portion 320 crimped to the twisted portion 305.

The facing portion 321*a* of the non-crimping portion 321 is substantially in the form of a plate and extends from the placing portion 320*a* of the barrel portion 320 toward the untwisted portion 306 as shown in FIGS. 2 and 3. The facing portion 321*a* includes a first part 321*aa* in the form of an elongated plate. The first part 321*aa* extends along a direction orthogonal to the longitudinal direction of the placing portion 320*a*. Further, the facing portion 321*a* includes a slightly curved second part 321*ab* connecting the first part 321*aa* and the placing portion 320*a*. The pair of rising portions 321*b* respectively rise from both longitudinal end parts of the first part 321*aa* of the facing portion 321*a*. In the non-crimping portion 321 of this example, an angle $\alpha$ (see FIG. 4) formed by the rising portion 321*b* and the first part 321*aa* of the facing portion 321*a* is, for example, set at 90°.

Figure 5:
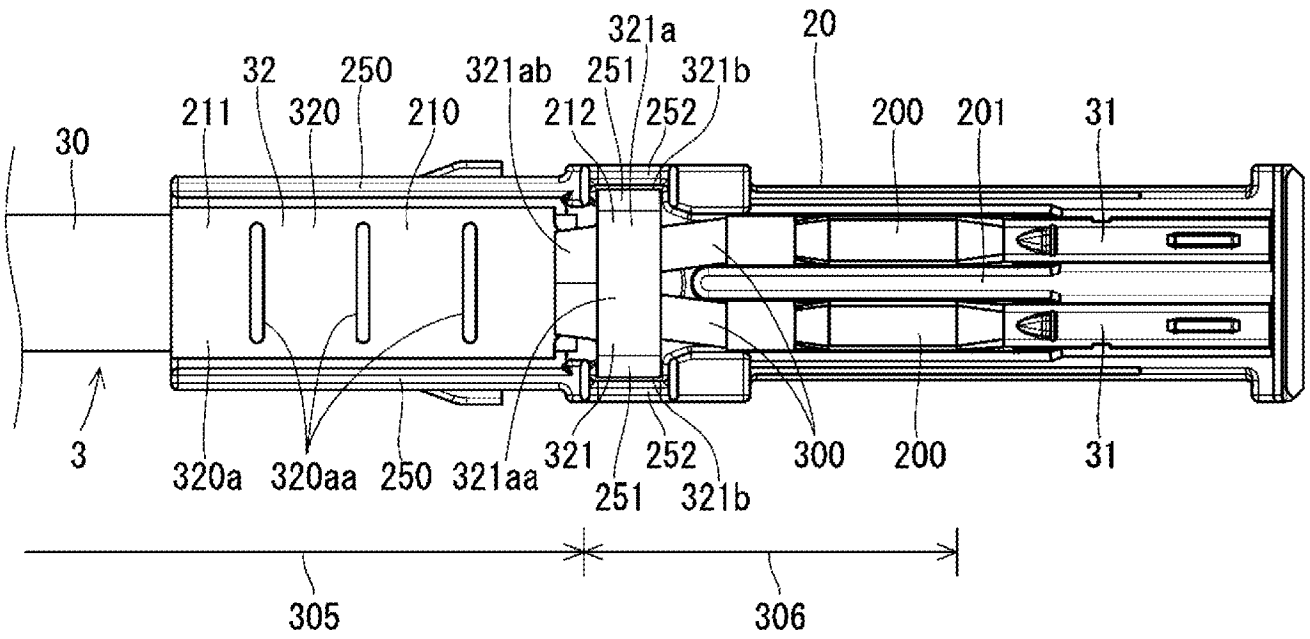
FIG. 5 is a plan view showing an example of a state where an end part of the member-equipped twisted pair cable according to the embodiment is accommodated in a body portion.
Figure 6:
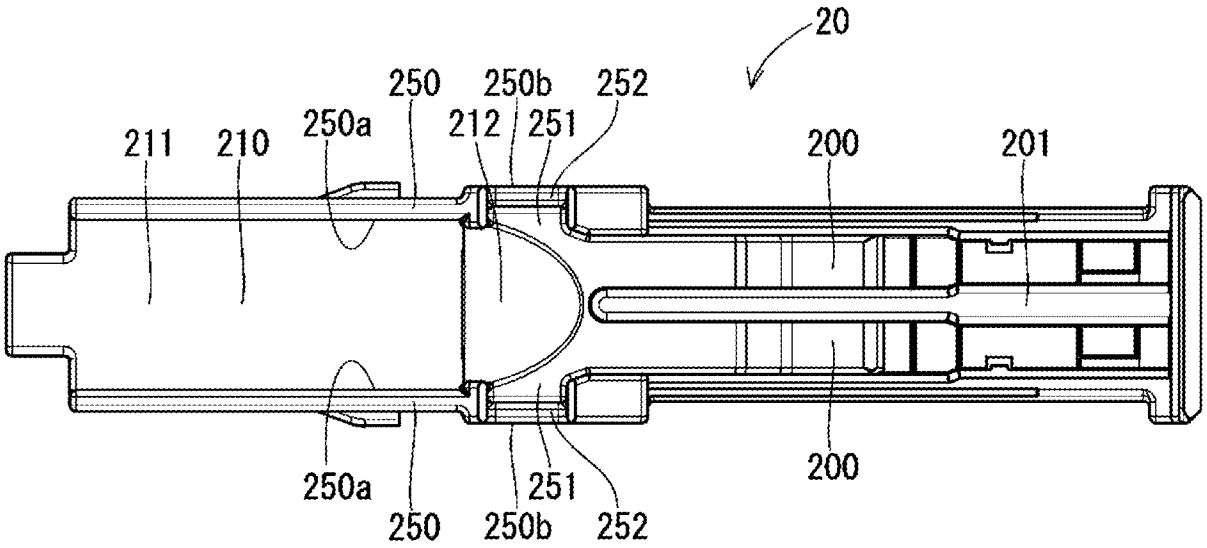
FIG. 6 is a plan view showing an example of the body portion according to the embodiment.
Figure 7:
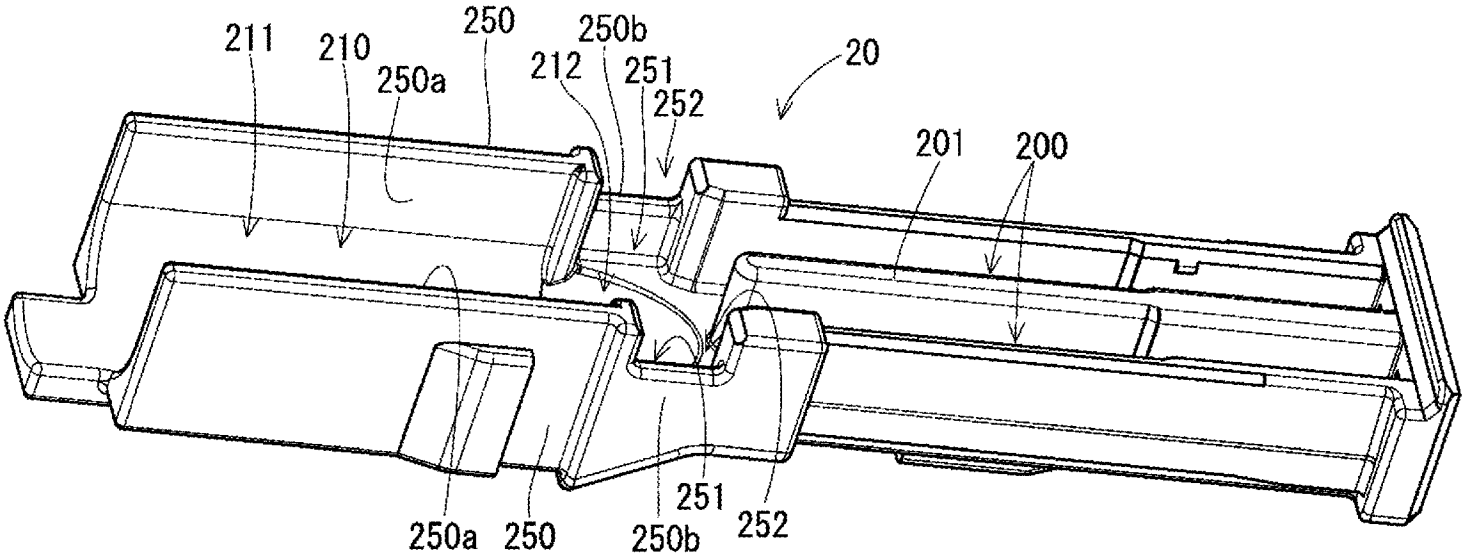
FIG. 7 is a perspective view showing the example of the body portion according to the embodiment.

The terminals 31 and the crimping member 32 of the member-equipped twisted pair cable 3 having the above configuration are accommodated into the body portion 20 of the housing 2. FIG. 5 is a schematic plan view showing an example of a state where the terminals 31 and the crimping member 32 are accommodated in the body portion 20. The body portion 20 having the cover portion 21 removed therefrom is shown in FIG. 5. FIG. 6 is a schematic plan view showing an example of the body portion 20. FIG. 7 is a schematic perspective view showing the example of the body portion 20.

As shown in FIGS. 5 to 7, the body portion 20 includes two terminal accommodating portions 200 for respectively accommodating the two terminals 31. The two terminal accommodating portions 200 are partitioned by a partition wall 201. Further, the body portion 20 includes a crimping member accommodating portion 210 connected to the terminal accommodating portions 200 for accommodating the crimping member 32. The crimping member accommodating portion 210 includes a first accommodating portion 211 for accommodating the barrel portion 320 of the crimping member 32 and a second accommodating portion 212 for accommodating the non-crimping portion 321 of the crimping member 32. As shown in FIG. 5, the non-crimping portion 321 is so accommodated in the second accommodating portion 212 that the facing portion 321*a* is located on an opening side of the body portion 20. The cover portion 21 is so mounted on the body portion 20 as to cover the opening of the body portion 20. In this way, the terminals 31 and the crimping member 32 are covered by the cover portion 21.

In this example, out of inner surfaces 250*a* of side wall portions 250 of the body portion 20, regions defining the second accommodating portion 212 for accommodating the non-crimping portion 321 are recessed in conformity with the shapes of the rising portions 321*b* of the non-crimping portion 321. In this way, fitting recesses 251 into which the rising portions 321*b* are fit are formed inwardly of the side wall portions 250 of the body portion 20. A pair of the fitting recesses 251 into which the pair of rising portions 321*b* are respectively fit are provided inwardly of a pair of the side wall portions 250 of the body portion 20. The pair of fitting recesses 251 constitute parts of the second accommodating portion 212.

Figure 8:
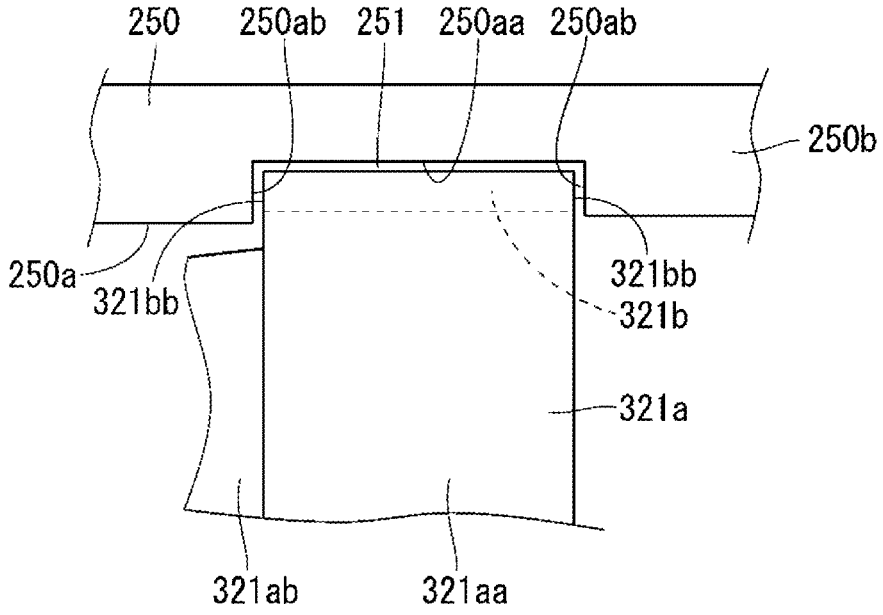
FIG. 8 is a plan view enlargedly showing the example of the state where the end part of the member-equipped twisted pair cable according to the embodiment is accommodated in the body portion.

FIG. 8 is a schematic plan view enlargedly showing a part near the fitting recess 251, out of a structure shown in FIG. 5. The communication wires 300 are not shown in FIG. 8. As shown in FIG. 8, a concave surface 250*aa* defining the fitting recess 251 is formed in the inner surface 250*a* of the side wall portion 250 of the body portion 20. The concave surface 250*aa* has a pair of facing surfaces 250*ab* respectively facing both end surfaces 321*bb* of the rising portion 321*b* fit in the fitting recess 251. The pair of facing surfaces 250*ab* are respectively facing the both end surfaces 321*bb* of the rising portion 321*b* in a longitudinal direction of the member-equipped twisted pair cable 3. In this way, the position of the crimping member 32 in the longitudinal direction of the member-equipped twisted pair cable 3 is restricted. Therefore, the escape of the terminals 31 from the housing 2 can be suppressed.

Further, by fitting the rising portions 321*b* into the fitting recesses 251 when the crimping member 32 and the terminals 31 are accommodated into the body portion 20, the crimping member 32 and the terminals 31 can be easily positioned in the body portion 20.

Further, in this example, the side wall portions 250 of the body portion 20 include cutout portions 252 in surfaces provided with the fitting recesses 251 as shown in FIGS. 5 to 7. In this example, end surfaces of parts 250*b* provided with the fitting recesses 251 in the side wall portions 250 are recessed, whereby the cutout portions 252 are provided in these parts 250*b*. Hemming bent portions 521*b* of a crimping member 52 to be described later can be arranged in the cutout portions 252. This point is described in detail later.

As described above, in the non-crimping portion 321 of the crimping member 32 made of metal and provided in the communication cable 1 of this example, the rising portions 321*b* surround the two communication wires 300 of the untwisted portion 306 together with the facing portion 321*a*. In this way, the two communication wires 300 of the untwisted portion 306 are surrounded by metal members.

In contrast, if the member-equipped twisted pair cable 3 includes no crimping member 32, the impedance of the untwisted portion 306 in which the two communication wires 300 are untwisted may become larger than the impedance of the twisted portion 305. As a result, it becomes difficult to keep the impedance of the communication cable 1 within a desired range. For example, if the communication cable 1 is formed to conform to the Ethernet standards, the impedance of the untwisted portion 306 becomes larger than 100Ω determined by the Ethernet standards and it possibly becomes difficult to keep the impedance of the communication cable 1 within a range of 100 Ω±10%.

Since the two communication wires 300 of the untwisted portion 306 are surrounded by the metal members in this example, the impedance of the untwisted portion 306 can be reduced. Thus, the impedance of the communication cable 1 is easily kept within the desired range. For example, if the communication cable 1 is formed to conform to the Ethernet standards, the impedance of the communication cable 1 is easily kept within the range of 100 Ω±10%. Therefore, the communication cable 1 can easily meet the Ethernet standards.

Further, since the fitting recesses 251 into which the rising portions 321*b* of the crimping member 32 are fit are provided inwardly of the side wall portions 250 of the housing 2 in this example, the position of the crimping member 32 can be restricted using these fitting recesses 251. Therefore, the escape of the terminals 31 from the housing 2 can be suppressed.

Further, since the rising portions 321*b* surround the two communication wires 300 of the untwisted portion 306 together with the facing portion 321*a* in this example, the impedance of the untwisted portion 306 can be reduced even in the case of using an inexpensive twisted pair cable 30 including no cable shield member like an UTP cable.

Note that the communication cable 1 may or may not include a shield member for covering the housing 2. For example, if the twisted pair cable 30 includes the cable shield member, the communication cable 1 may include a shield member for covering the housing 2. Further, if the twisted pair cable 30 includes no cable shield member, the communication cable 1 may include no shield member for covering the housing 2. In this example, the impedance of the untwisted portion 306 can be reduced even if the communication cable 1 is an inexpensive communication cable including no cable shield member and no shield member for covering the housing 2.

Further, the communication cable 1 may include an outer housing for accommodating the housing 2. In this case, the housing 2 may be called an inner housing. If the communication cable 1 includes the outer housing, the communication cable 1 may or may not include a shield member for covering the outer housing. For example, if the twisted pair cable 30 includes the cable shield member, the communication cable 1 may include the shield member for covering the outer housing. Further, if the twisted pair cable 30 includes no cable shield member, the communication cable 1 may include no shield member for covering the outer housing. Further, the communication cable 1 may include a plurality of member-equipped twisted pair cables 3, a plurality of housings 2 for respectively accommodating end parts of the plurality of member-equipped twisted pair cables 3 and an outer housing for accommodating the plurality of housings 2.

Further, the barrel portion 320 of the crimping member 32 may include two or more crimping pieces 320*b* and two or more crimping pieces 320*c*. Further, the barrel portion 320 may include one crimping piece 320*b* and one crimping piece 320*c*. The numbers of the crimping pieces 320*b*, 320*c* are appropriately determined according to a length of the barrel portion 320. Further, the number of the slits 320*aa* is also appropriately determined according to the length of the barrel portion 320. The length of the barrel portion 320 of the crimping member 32 shown in FIG. 3 is, for example, 9 mm Note that the length of the barrel portion 320 may be other than 9 mm.

Figure 9:
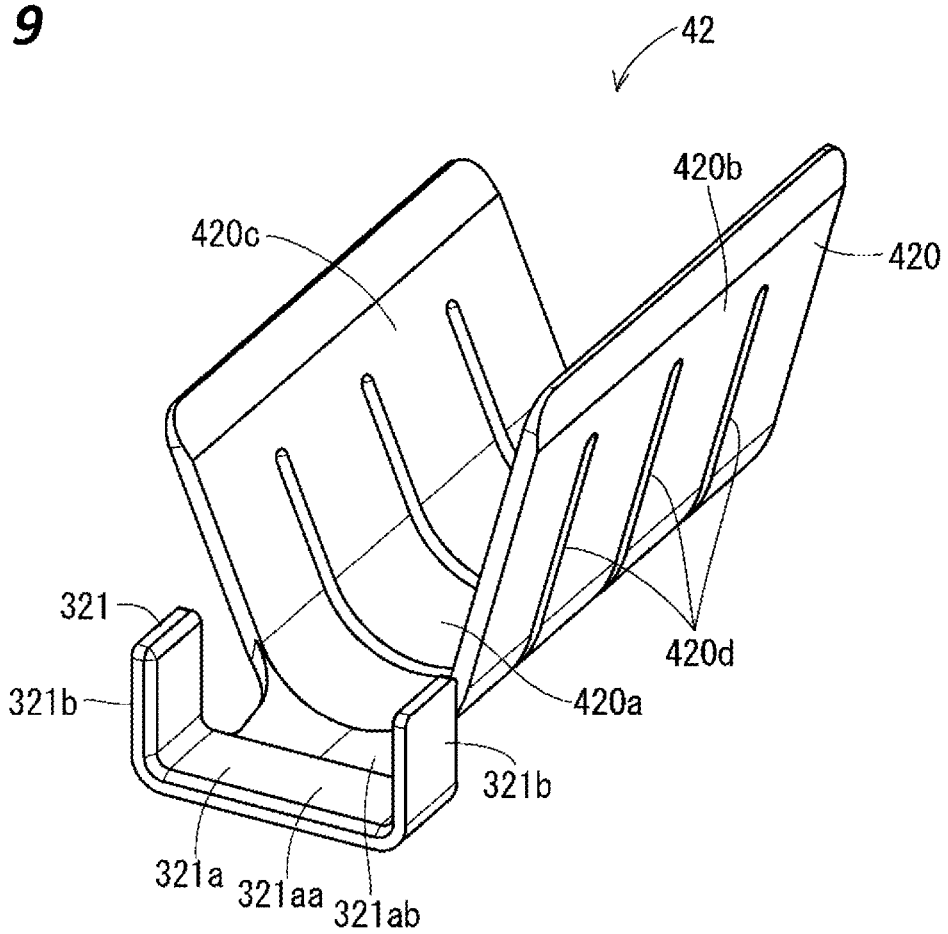
FIG. 9 is a perspective view showing an example of the crimping member according to the embodiment.

Further, the shape of the crimping member provided in the member-equipped twisted pair cable 3 is not limited to that of the above example. For example, a crimping member 42 shown in FIG. 9 may be used instead of the aforementioned crimping member 32. As shown in FIG. 9, the crimping member 42 includes a barrel portion 420 to be crimped to the twisted portion 305 and the aforementioned non-crimping portion 321. FIG. 9 shows the barrel portion 420 before being crimped to the twisted portion 305.

The barrel portion 420 includes a placing portion 420*a* on which the twisted portion 305 is placed. The placing portion 420*a* extends along the longitudinal direction of the twisted portion 305 and is curved into a U shape. Further, the barrel portion 420 includes two crimping pieces 420*b*, 420*c* respectively extending obliquely upward toward outer sides from both side edges along a longitudinal direction of the placing portion 420*a*. The placing portion 420*a* and the crimping pieces 420*b*, 420*c* are provided with a plurality of slits 420*d*. The plurality of slits 420*d* are arranged while being separated from each other along the longitudinal direction of the placing portion 420*a*. Each slit 420*d* extends along the curving of the placing portion 420*a*. The number of the slits 420*d* is appropriately determined according to a length of the barrel portion 420. The length of the barrel portion 420 of the crimping member 42 shown in FIG. 9 is, for example, 9 mm. Note that the length of the barrel portion 320 may be other than 9 mm.

The barrel portion 420 is so crimped to the twisted portion 305 that the placing portion 420*a* and the crimping pieces 420*b*, 420*c* are in contact with the outer peripheral surface of the twisted portion 305 and tip parts of the upward extending crimping pieces 420*b*, 420*c* overlap each other. In this way, the outer peripheral surface of the twisted portion 305 is surrounded by the placing portion 420*a* and the crimping pieces 420*b*, 420*c*. In the crimping member 42, the facing portion 321*a* of the non-crimping portion 321 extends from the placing portion 420*a* of the barrel portion 42.

Even if the member-equipped twisted pair cable 3 includes the crimping member 42 shown in FIG. 9, the impedance of the untwisted portion 306 can be reduced. Therefore, the impedance of the communication cable 1 is easily kept within the desired range.

Figure 10:
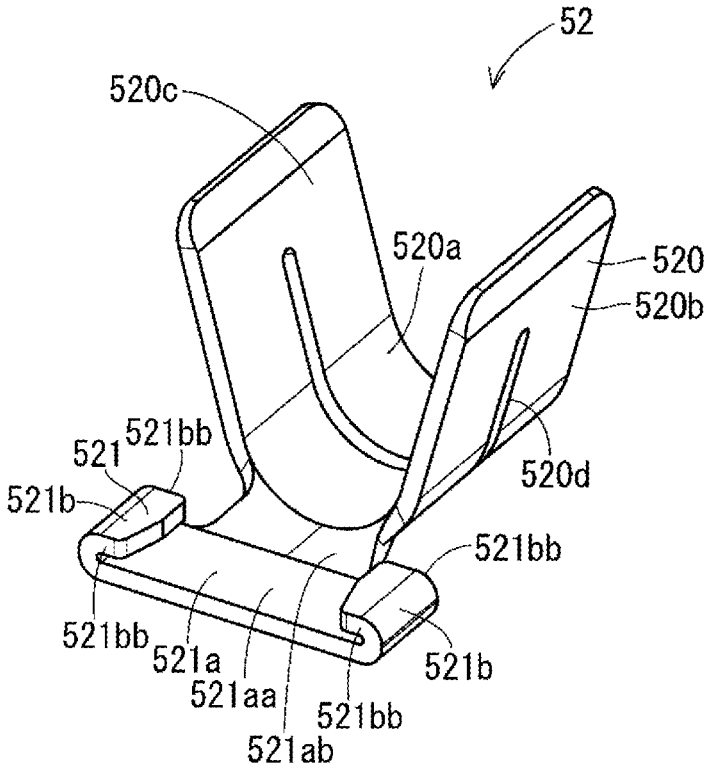
FIG. 10 is a perspective view showing an example of the crimping member according to the embodiment.

Further, the crimping member 52 shown in FIG. 10 may be used instead of the aforementioned crimping member 32. As shown in FIG. 10, the crimping member 52 includes a barrel portion 520 to be crimped to the twisted portion 305 and a non-crimping portion 521 not to be crimped to the twisted pair cable 30. FIG. 10 shows the barrel portion 520 before being crimped to the twisted portion 305. The barrel portion 520 has such a structure obtained, such as by shortening the length of the barrel portion 420 shown in FIG. 9.

Figure 11:
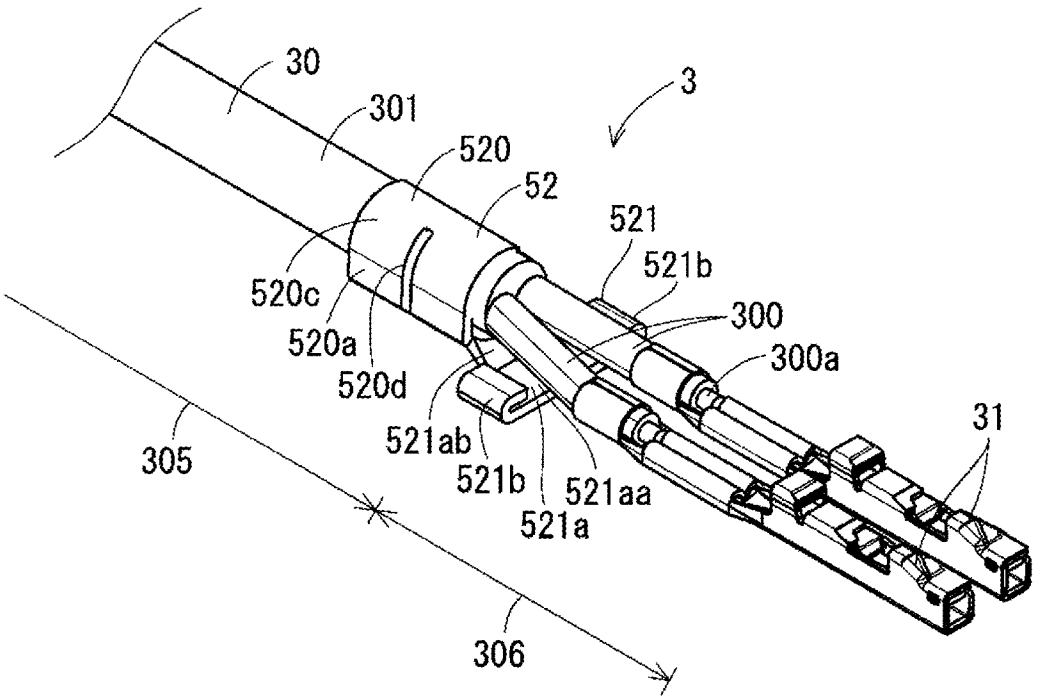
FIG. 11 is a perspective view showing an example of the member-equipped twisted pair cable according to the embodiment.
Figure 12:
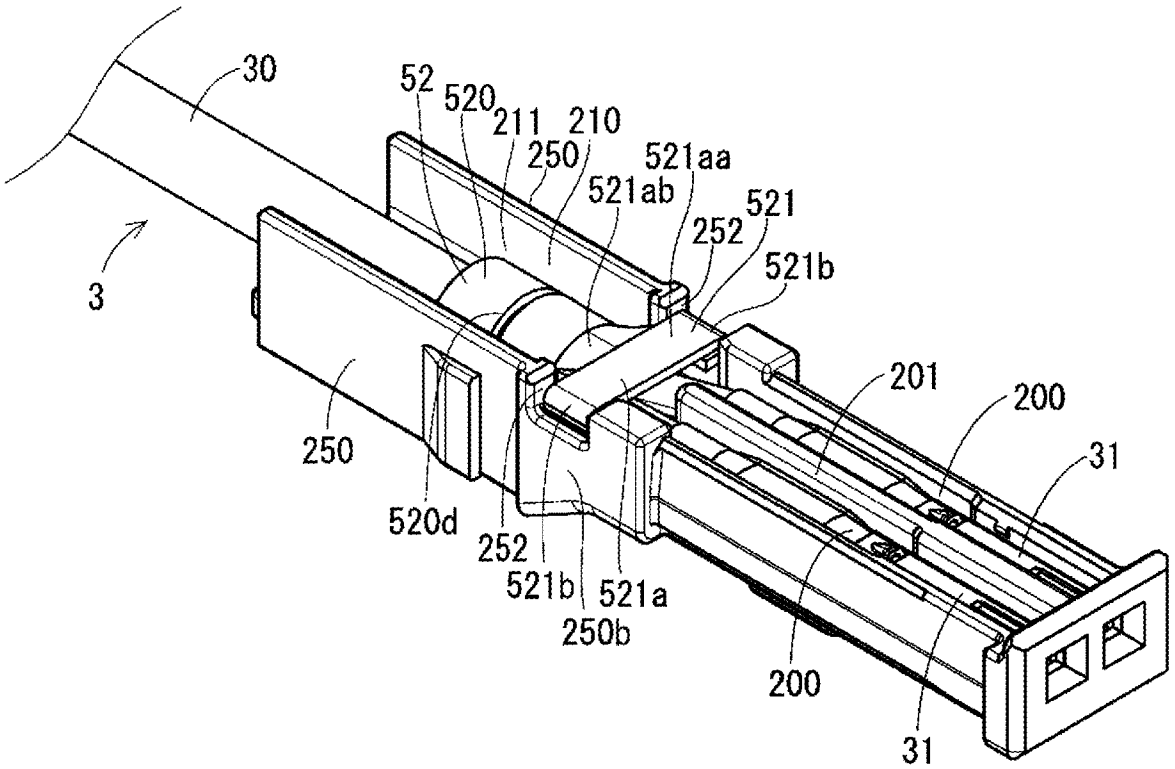
FIG. 12 is a perspective view showing the example of the state where the end part of the member-equipped twisted pair cable according to the embodiment is accommodated in the body portion.

FIG. 11 is a schematic perspective view showing an example of the member-equipped twisted pair cable 3 provided with the crimping member 52 instead of the crimping member 32. FIG. 12 is a schematic perspective view showing an example of a state where the body portion 20 of the housing 2 is mounted on the member-equipped twisted pair cable 3 shown in FIG. 11.

As shown in FIGS. 10 to 12, the barrel portion 520 includes a placing portion 520*a* on which the twisted portion 305 is placed. The placing portion 520*a* is curved into a U shape. Further, the barrel portion 520 includes two crimping pieces 520*b*, 520*c* respectively extending obliquely upward toward outer sides from both side edges of the placing portion 520*a*. The placing portion 520*a* and the crimping pieces 520*b*, 520*c* are provided with one slit 520*d*. The slit 520*d* extends along the curving of the placing portion 520*a*. Note that the number of the slit(s) 520*d* is appropriately determined according to a length of the barrel portion 520. The length of the barrel portion 520 shown in FIG. 10 is, for example, 4 mm Note that the length of the barrel portion 520 may be other than 4 mm.

The barrel portion 520 is so crimped to the twisted portion 305 that the placing portion 520*a* and the crimping pieces 520*b*, 520*c* are in contact with the outer peripheral surface of the twisted portion 305 and tip parts of the upward extending crimping pieces 520*b*, 520*c* overlap each other.

The non-crimping portion 521 includes a facing portion 521*a* facing the two communication wires 300 in the untwisted portion 306. The facing portion 521*a* includes a first part 521*aa* in the form of an elongated plate. Further, the facing portion 521*a* includes a slightly curved second part 521*ab* connecting the first part 521*aa* and the placing portion 520*a*. Both end parts in a direction orthogonal to the longitudinal direction of the untwisted portion 306 in the first part 521*aa* of the facing portion 521*a* are folded 180°. In this way, a pair of the hemming bent portions 521*b* are respectively formed on both ends of the first part 521*aa* of the facing portion 521*a*.

In this example, the body portion 20 can accommodate not only crimping members including the rising portions 321*b* like the crimping members 32 and 42, but also crimping members including the hemming bent portions 521*b* like the crimping member 52.

As shown in FIG. 12, the barrel portion 520 of the crimping member 52 is accommodated in the first accommodating portion 211 of the crimping member accommodating portion 210. The non-crimping portion 521 is so arranged that the facing portion 521*a* is located on the opening side of the body portion 20. The pair of hemming bent portions 521*b* are respectively accommodated in the cutout portions 252 of the pair of side wall portions 250.

Figure 13:
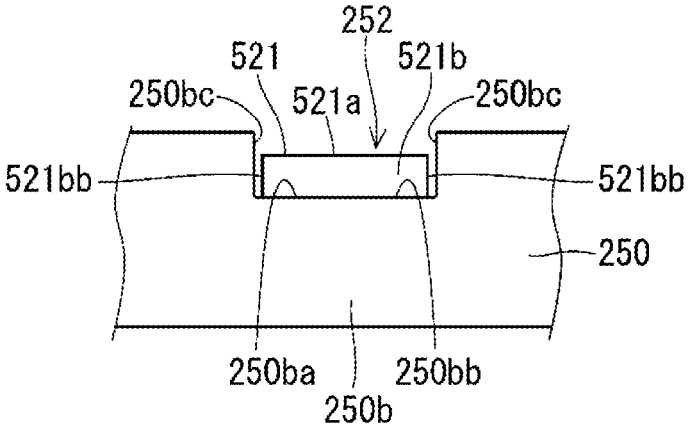
FIG. 13 is a side view showing an example of a state where a hemming bent portion of the crimping member according to the embodiment is accommodated in a cutout portion of the body portion.

FIG. 13 is a side view schematically showing a part near the cutout portion 252, out of a structure shown in FIG. 12. As shown in FIG. 13, a concave surface 250*ba* defining the cutout portion 252 is formed in an end surface of a part 250*b* provided with the fitting recess 251, out of the side wall portion 250 of the body portion 20. The hemming bent portion 521*b* of the non-crimping portion 521 is placed on a bottom surface 250*bb* of the concave surface 250*ba*. A pair of side surfaces 250*bc* of the concave surface 250*ba* are respectively facing both end surfaces 521*bb* of the hemming bent portion 521*b* accommodated in the cutout portion 252. The pair of side surfaces 250*bc* are respectively facing the both end surfaces 521*bb* of the hemming bent portion 521*b* in the longitudinal direction of the member-equipped twisted pair cable 3. In this way, the position of the crimping member 52 is restricted in the longitudinal direction of the member-equipped twisted pair cable 3. Therefore, the escape of the terminals 31 from the housing 2 can be suppressed.

As just described, in this example, the side wall portions 250 of the body portion 20 include the cutout portions 252 in the surfaces provided with the fitting recesses 251. By arranging the hemming bent portions 521*b* in the cutout portions 252 for the crimping member including the hemming bent portions 521*b* instead of the rising portions 321*b* in this way, the position of the crimping member including the hemming bent portions 521*b* can be restricted. Therefore, the housing 2 can be commonly used for the communication cable 1 with the crimping member including the rising portions 321*b* and for the communication cable 1 with the crimping member including the hemming bent portions 521*b*.

If the member-equipped twisted pair cable 3 includes the crimping member 52 made of metal and shown in FIGS. 10 to 12, the two communication wires 300 of the untwisted portion 306 are facing the facing portion 521*a* of the non-crimping portion 521. In this way, a metal member is present around the two communication wires 300 of the untwisted portion 306. Therefore, the impedance of the untwisted portion 306 can be reduced as compared to the case where the member-equipped twisted pair cable 3 include no crimping member. As a result, the impedance of the communication cable 1 is easily kept within the desired range.

Further, if the crimping member provided in the member-equipped twisted pair cable 3 includes the rising portions 321*b*, the two communication wires 300 of the untwisted portion 306 are surrounded by the metal members in a wider range than in the case of including the hemming bent portions 521*b*. In this way, the impedance of the untwisted portion 306 can be more reduced. Therefore, if the crimping member of the communication cable 1 includes the rising portions 321*b*, the impedance of the communication cable 1 is more easily kept within the desired range.

Here, the communication cable 1 including the crimping member 52 with the barrel portion 520 having a length of 9 mm (crimping member including the hemming bent portions 521*b*) is called a communication cable 1A. The barrel portion 520 of the crimping member 52 of the communication cable 1A is, for example, formed with three slits 520*d* similarly to the barrel portion 420 shown in FIG. 9. Further, the communication cable 1 including the crimping member 42 with the barrel portion 420 having a length of 9 mm (crimping member including the rising portions 321*b*) is called a communication cable 1B.

The inventors of the present application measured impedances of the untwisted portions 306 of the communication cables 1A, 1B and compared those impedances. As a result, it was confirmed that the impedance of the untwisted portion 306 of the communication cable 1B including the rising portions 321*b* was lower by about 0.1% than the impedance of the untwisted portion 306 of the communication cable 1A including the hemming bent portions 521*b*. It was also confirmed that the impedance of the untwisted portion 306 of the communication cable 1B including the rising portions 321*b* was closer to 100Ω determined by the Ethernet standards than the impedance of the untwisted portion 306 of the communication cable 1A including the hemming bent portion 521*b*.

The length of the barrel portion of the crimping member 52 including the hemming bent portions 521*b* may be set more than 4 mm. Similarly, the length of the barrel portion of the crimping member including the rising portions 321*b* may be set more than 4 mm. The impedance of the untwisted portion 306 can be further reduced by setting the length of the barrel portion of the crimping member more than 4 mm Therefore, the impedance of the communication cable 1 is more easily kept within the desired range.

Here, the communication cable 1 including the crimping member 52 shown in FIG. 10, i.e. the crimping member 52 with the barrel portion 520 having a length of 4 mm (crimping member including the hemming bent portions 521*b*) is called a communication cable 1C.

The inventors of the present application measured an impedance of the untwisted portion 306 of the communication cable 1C and the impedances of the untwisted portions 306 of the aforementioned communication cables 1A, 1B and compared those impedances. As a result, it was confirmed that the impedance of the untwisted portion 306 of the communication cable 1A including the barrel portion having a length of 9 mm and the hemming bent portions was lower by about 1.7% than the impedance of the untwisted portion 306 of the communication cable 1C including the barrel portion having a length of 4 mm and the hemming bent portions. It was also confirmed that the impedance of the untwisted portion 306 of the communication cable 1B including the barrel portion having a length of 9 mm and the rising portions was lower by about 1.8% than the impedance of the untwisted portion 306 of the communication cable 1C including the barrel portion having a length of 4 mm and the hemming bent portions. Then, it was confirmed that the impedances of the untwisted portions 306 of the communication cables 1A, 1B were closer to 100Ω determined by the Ethernet standards than the impedance of the untwisted portion 306 of the communication cable 1C. As the length of the barrel portion increases, the impedance of the untwisted portion 306 decreases and can be made closer to 100Ω.

Figure 14:
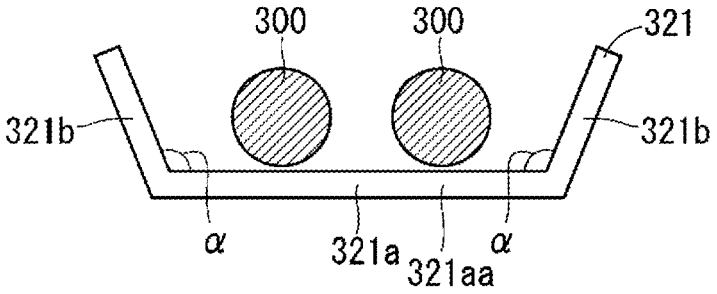
FIG. 14 is a section showing an example of the non-crimping portion according to the embodiment.
Figure 15:
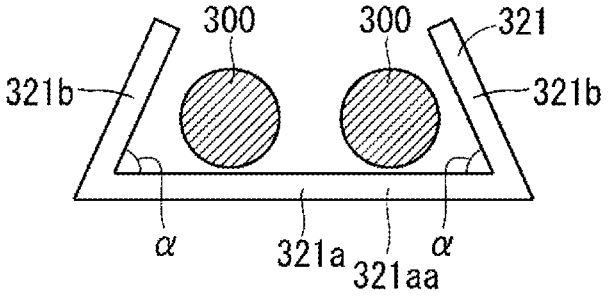
FIG. 15 is a section showing an example of the non-crimping portion according to the embodiment.

Although the angle α formed by the rising portion 321*b* and the facing portion 321*a* is 90° in the above example, the angle α may be larger than 90° as shown in FIG. 14 or may be smaller than 90° as shown in FIG. 15. If the angle α is set equal to or smaller than 90° as shown in FIG. 4 described above and FIG. 15, outward expansion of the rising portions 321*b* can be prevented. Therefore, the non-crimping portion 321 for reducing the impedance of the untwisted portion 306 can be made smaller.

Figure 16:
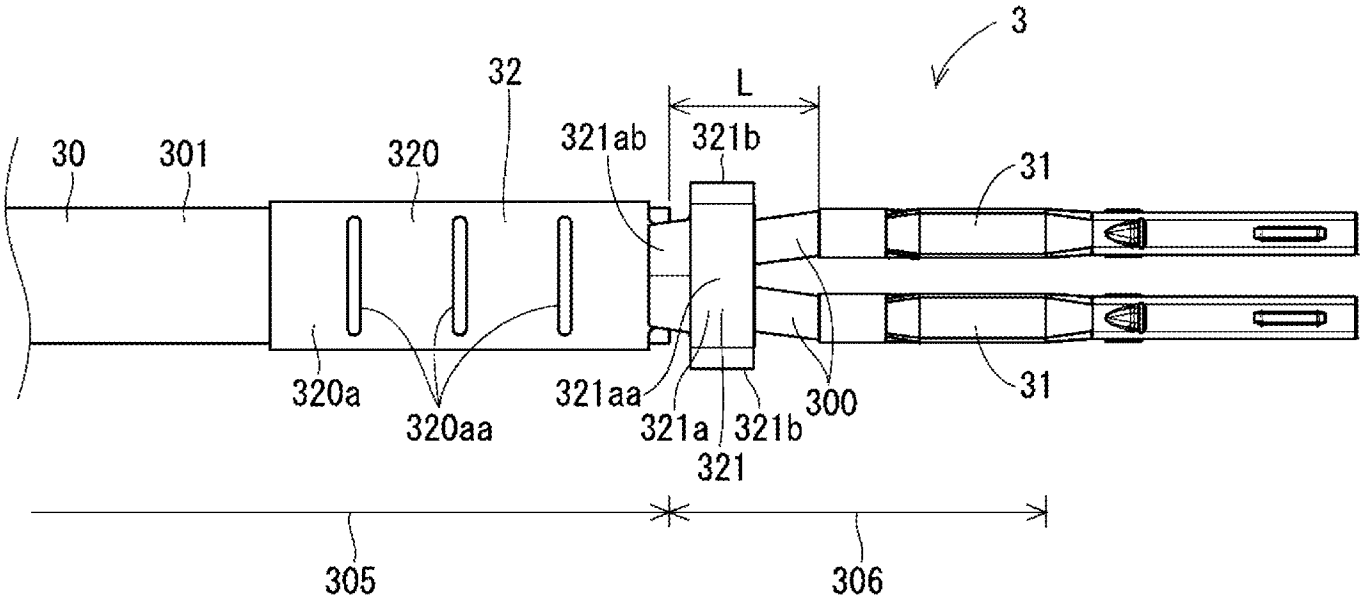
FIG. 16 is a plan view showing an example of the member-equipped twisted pair cable according to the embodiment.

Further, regardless of whether the communication cable 1 includes the rising portions 321*b* or the hemming bent portions 521*b*, a length L from one end of the untwisted portion 306 on the side of the twisted portion 305 to the terminals 31 may be 4 mm or less. FIG. 16 is a schematic plan view showing an example of the member-equipped twisted pair cable 3 provided with the rising portions 321*b*. FIG. 16 shows the length L from the one end of the untwisted portion 306 on the side of the twisted portion 305 to the terminals 31. The length L can be said to be a length from the one end of the untwisted portion 306 on the side of the twisted portion 305 to one ends of the terminals 31 on the side of the twisted portion 305. Since a length of a part of the untwisted portion 306 not connected to the terminals 31 decreases as the length L decreases, an increase of the impedance of the untwisted portion 306 can be suppressed. Therefore, by setting the length L at 4 mm or less, an increase of the impedance of the untwisted portion 306 can be more easily suppressed. As a result, the impedance of the communication cable 1 is more easily kept within the desired range.

Further, regardless of whether the communication cable 1 includes the rising portions 321*b* or the hemming bent portions 521*b*, a distance D between cross-sectional centers of the two communication wires 300 in the untwisted portion 306 may be 2.0 mm or less. For example, the distance D between cross-sectional centers of parts accommodated in the two terminal accommodating portions 200 of the body portion 20 of the housing 2, out of the two communication wires 300 of the untwisted portion 306, may be 2.0 mm or less.

Figure 17:
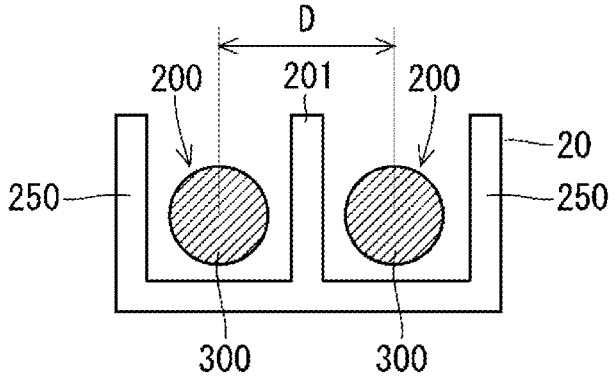
FIG. 17 is a section showing a state where communication wires of an untwisted portion of the communication cable according to the embodiment are accommodated in the body portion.

FIG. 17 is a schematic section showing a state where the two communication wires 300 of the untwisted portion 306 are respectively accommodated in the two terminal accommodating portions 200 of the body portion 20. The terminals 31 are not shown in FIG. 17. FIG. 17 shows the distance D between the cross-sectional centers of the parts accommodated in the two terminal accommodating portions 200, out of the two communication wires 300 of the untwisted portion 306. In the untwisted portion 306, since the two communication wires 300 are closer to each other as the distance D decreases, an increase of the impedance of the untwisted portion 306 can be suppressed. Therefore, an increase of the impedance of the untwisted portion 306 can be suppressed by setting the distance D at 2.0 mm or less. As a result, the impedance of the communication cable 1 is more easily kept within the desired range. Note that a distance between the cross-sectional centers of the two communication wires 300 in the twisted portion 305 is, for example, 0.9 mm.

Although the communication cable and the crimping member are described in detail above, the above description is illustrative in all aspects and this disclosure is not limited thereby. Further, various modifications described above can be applied in combination as long as these do not contradict each other. It is understood that unillustrated numeral modifications can be assumed without departing from the scope of this disclosure.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A communication cable, comprising:

a twisted pair cable including two communication wires twisted with each other;

a terminal; and a crimping member made of metal, wherein:

the twisted pair cable includes a twisted portion in which the two communication wires are twisted with each other and an untwisted portion in which the two communication wires are untwisted, the untwisted portion extending from the twisted portion, the terminal is connected to a tip part of the untwisted portion, the crimping member includes a barrel portion crimped to an end part of the twisted portion and a non-crimping portion extending from the barrel portion toward the untwisted portion and not crimped to the twisted pair cable, and the non-crimping portion includes a facing portion facing the two communication wires in the untwisted portion and rising portions rising from end parts of the facing portion in a direction orthogonal to the facing portion, the facing portion extending in a longitudinal direction along the untwisted portion, the rising portions surrounding the two communication wires together with the facing portion.

2. The communication cable of claim 1, wherein an angle formed by the rising portions and the facing portion is 90° or less.

3. The communication cable of claim 1, wherein a length from one end of the untwisted portion on the side of the twisted portion to the terminal is 4 mm or less.

4. The communication cable of claim 1, wherein a length of the barrel portion is more than 4.0 mm.

5. The communication cable of claim 1, wherein a distance between cross-sectional centers of the two communication wires in the untwisted portion is 2.0 mm or less.

6. The communication cable of claim 1, further comprising a housing for accommodating the terminal and the crimping member.

7. The communication cable of claim 6, wherein fitting recesses into which the rising portions are fit are provided inwardly of side wall portions of the housing.

8. The communication cable of claim 7, wherein:

the housing includes a body portion for accommodating the terminal and the crimping member and a cover portion for covering the body portion, the fitting recesses are provided inwardly of side wall portions of the body portion, and the side wall portions of the body portion include cutout portions in surfaces provided with the fitting recesses.

9. The communication cable of claim 6, wherein the communication cable meets Ethernet (registered trademark) standards.

10. The communication cable of claim 6, wherein:

the twisted pair cable includes no cable shield member, and the communication cable includes no shield member for covering the housing.

11. The communication cable of claim 1, wherein the twisted pair cable includes no cable shield member.

12. A communication cable comprising:

a twisted pair cable including two communication wires twisted together;

a pair of terminals; and a crimping member made of metal, wherein, the twisted pair cable includes a twisted portion in which the two communication wires are twisted together and an untwisted portion in which the two communication wires are untwisted, the untwisted portion extending from the twisted portion, each tip of the untwisted portion of the two communication wires includes one of the pair of terminals attached thereto, the crimping member includes a barrel portion having a placing portion extending in the longitudinal direction on which the twisted portion is placed, a first plurality of crimping pieces extending from one side of the placing portion, and a second plurality of crimping pieces extending from another side of the placing portion opposite the one side of the placing portion, the first plurality of crimping pieces and second plurality of crimping pieces are alternatively arranged side by side along the longitudinal direction as to not overlap each other when the barrel portion is crimped to an end of the twisted portion, and a non-crimping portion extending from the barrel portion toward the tips of the untwisted portion and not crimped to the twisted pair cable, and the non-crimping portion includes a facing plate extending from the placing portion to face the two communication wires in the untwisted portion and a pair of rising portions arranged along the longitudinal direction, each rising portion having a first end attached to opposites ends of the facing plate and a second end, opposite the first end, extending upwardly in a direction orthogonal to a plane parallel to the facing plate.

* * * * *